US010351411B2

(12) United States Patent
Ziesel

(10) Patent No.: US 10,351,411 B2
(45) Date of Patent: Jul. 16, 2019

(54) COOLING SYSTEMS FOR BEVERAGE DISPENSERS AND METHODS OF MAINTAINING A COOLING SYSTEM

(71) Applicant: THE COCA-COLA COMPANY, Atlanta, GA (US)

(72) Inventor: Lawrence B. Ziesel, Atlanta, GA (US)

(73) Assignee: The Coca-Cola Company, Atlanta, GA (US)

( * ) Notice: Subject to any disclaimer, the term of this patent is extended or adjusted under 35 U.S.C. 154(b) by 0 days.

(21) Appl. No.: 15/108,504

(22) PCT Filed: Dec. 18, 2014

(86) PCT No.: PCT/US2014/071277

§ 371 (c)(1),
(2) Date: Jun. 27, 2016

(87) PCT Pub. No.: WO2015/100139

PCT Pub. Date: Jul. 2, 2015

(65) Prior Publication Data

US 2016/0347596 A1 Dec. 1, 2016

Related U.S. Application Data

(60) Provisional application No. 61/920,867, filed on Dec. 26, 2013.

(51) Int. Cl.

| | |
|---|---|
| ***B67D 1/00*** | (2006.01) |
| ***B67D 1/08*** | (2006.01) |
| ***F25D 31/00*** | (2006.01) |

(52) U.S. Cl.

CPC ..... *B67D 1/0064* (2013.01); *B67D 1/0021* (2013.01); *B67D 1/0066* (2013.01); (Continued)

(58) Field of Classification Search

CPC .. B67D 1/0064; B67D 1/0078; B67D 1/0021; B67D 1/0066; B67D 1/0862; F25D 31/002

See application file for complete search history.

(56) References Cited

U.S. PATENT DOCUMENTS 3,240,395 A * 3/1966 Carver ..... B67D 1/0021 222/129.1
4,781,309 A * 11/1988 Vogel ..... B67D 1/0021 137/561 A (Continued)

FOREIGN PATENT DOCUMENTS

EP 1826171 A2 8/2007
JP H03-199828 A 8/1991

(Continued)

OTHER PUBLICATIONS

Yuichi Ishiguro, Japanese Office Action, dated Jun. 27, 2018, pp. 1-11, Japanese Patent Office, Tokyo, Japan.

(Continued)

*Primary Examiner* — Donnell A Long

(57) ABSTRACT

A cooling system for use in a beverage dispenser, the cooling system including: a cold plate having a top surface and a side surface; a carbonator arranged in a non-horizontal orientation relative to the cold plate, the carbonator having a sidewall, a lower uninsulated portion of the sidewall of the carbonator being in thermal communication with the side surface of the cold plate; and a fastener coupling the carbonator to the cold plate, the fastener having a lower thermal conductivity as compared to a thermal conductivity of the carbonator.

18 Claims, 4 Drawing Sheets

(52) U.S. Cl.
CPC ..... *B67D 1/0078* (2013.01); *B67D 1/0862* (2013.01); *F25D 31/002* (2013.01)

(56) References Cited

U.S. PATENT DOCUMENTS

| | | | | |
|---|---|---|---|---|
| 5,319,947 | A * | 6/1994 | Fischer | B67D 1/0857 222/146.6 |
| 5,392,960 | A | 2/1995 | Kendt et al. | |
| 5,419,461 | A | 5/1995 | Goulet | |
| 5,564,602 | A | 10/1996 | Cleland et al. | |
| 5,694,787 | A | 12/1997 | Cleleand et al. | |
| 5,970,732 | A | 10/1999 | Menin et al. | |
| 5,996,842 | A | 12/1999 | Riley et al. | |
| 6,155,069 | A * | 12/2000 | Quartarone | B67D 1/0862 222/129.1 |
| 6,463,753 | B1 | 10/2002 | Haskayne | |
| 6,546,737 | B1 | 4/2003 | Heyes et al. | |
| 6,698,229 | B2 | 3/2004 | Renken et al. | |
| 6,945,070 | B1 * | 9/2005 | Jablonski | B67D 1/0057 62/390 |
| 7,296,428 | B2 | 11/2007 | Cleland | |
| 7,363,962 | B2 | 4/2008 | Cleland | |
| 2002/0033027 | A1 * | 3/2002 | Ubidia | B67D 1/0066 62/390 |
| 2002/0078706 | A1 | 6/2002 | Kyees | |
| 2002/0162350 | A1 * | 11/2002 | Haskayne | B67D 1/0058 62/390 |
| 2003/0066306 | A1 | 4/2003 | Renken et al. | |
| 2004/0216474 | A1 | 11/2004 | Jablonski et al. | |
| 2005/0097907 | A1 | 5/2005 | Cleland | |
| 2006/0162370 | A1 | 7/2006 | Haskayne | |
| 2006/0168987 | A1 | 8/2006 | Kyees | |
| 2007/0039348 | A1 | 2/2007 | Wolski et al. | |
| 2007/0228075 | A1 * | 10/2007 | Edwards | B67D 1/0021 222/129.1 |
| 2008/0047293 | A1 | 2/2008 | Kyees | |
| 2008/0092578 | A1 | 4/2008 | Yeagy et al. | |
| 2008/0264093 | A1 | 10/2008 | Winters | |
| 2010/0319364 | A1 | 12/2010 | Winters | |
| 2014/0263413 | A1 * | 9/2014 | Green | B67D 1/0058 222/1 |
| 2014/0361043 | A1 * | 12/2014 | Jablonski | B67D 1/0857 222/146.6 |

FOREIGN PATENT DOCUMENTS

| | | | |
|---|---|---|---|
| JP | H04-311495 | A | 11/1992 |
| JP | 2003-508315 | A | 3/2003 |
| JP | 2005-232207 | A | 9/2005 |
| JP | 2009-231495 | A | 10/2009 |
| JP | 2012-188163 | A | 10/2012 |
| WO | 2013112895 | A1 | 8/2013 |

OTHER PUBLICATIONS

Schultz, Tom, European Search Report, dated Jul. 11, 2017, pp. 1-9, European Patent Office, Munich, Germany.

Lee, Jong Kyung, International Search Report & Written Opinion, dated Apr. 27, 2015, pp. 1-16, Korean Intellectual Property Office, Daejeon Metropolitan City, Republic of Korea.

* cited by examiner

COOLING SYSTEMS FOR BEVERAGE DISPENSERS AND METHODS OF MAINTAINING A COOLING SYSTEM

This application is a U.S. National stage application of International Application PCT/US2014/071277 filed Dec. 18, 2014, which claims the benefit of U.S. Provisional Patent Application 61/920,867, filed Dec. 26, 2013, the disclosures of which are incorporated by reference in their entirety.

BACKGROUND

Ice cooled beverage dispensers incorporate cold plates for cooling beverage components as they flow through serpentine pathways therein. The cold plate normally has tubes or coils of a suitable material, such as stainless steel, imbedded in a heat conducting casting, such as an aluminum casting which can be several inches thick. Cold plates have been utilized to chill conventional carbonators. The cold plate cools the carbonator unit by conduction such that the water within the carbonator unit is also chilled as it flows therethrough. Dispensed carbonation levels decrease as the temperature in the carbonator tank increase. Up until now, carbonator tanks in contact with the cold plate are arranged in a horizontal lay out. There are a variety of disadvantages to this arrangement including inconsistent carbonation levels.

SUMMARY

In general terms, this disclosure is directed to a cooling system for use in beverage dispenser. In one possible configuration and by non-limiting example, the beverage dispenser has a cold plate and a carbonator unit. The cold plate is positioned in thermal contact with the carbonator.

One aspect is a cooling system for use in a beverage dispenser, the cooling system including: a cold plate having a top surface and a side surface; a carbonator arranged in a non-horizontal orientation to the cold plate, the carbonator having a sidewall, a lower uninsulated portion of the sidewall of the carbonator being in thermal communication with the side surface of the cold plate; and a fastener coupling the carbonator to the cold plate, the fastener having a lower thermal conductivity as compared to a thermal conductivity of the carbonator.

Another aspect is a beverage dispenser including: a sweetener inlet; a still water inlet; a nozzle; a cold plate having a first surface and a second surface, the first surface defining a portion of an ice storage area, the cold plate defining a portion of a fluid pathway between the sweetener inlet and the nozzle and a portion of a fluid pathway between the still water inlet and a carbonator; and the carbonator arranged in a non-horizontal orientation relative to the cold plate, the carbonator comprising a gas inlet, a liquid inlet in fluid communication with the still water inlet, and a liquid outlet in fluid communication with the nozzle, wherein the carbonator is in thermal communication with the second surface of the cold plate.

A further aspect is a method for causing convection currents of a fluid within a carbonator, the method including: connecting a portion of the carbonator to a portion of a cold plate, the carbonator orientated at an angle relative to the cold plate; cooling the cold plate; causing, in response to the cooling of the cold plate, a temperature drop of the fluid proximate the portion of the carbonator connected to the portion of the cold plate; and causing, in response to the temperature drop, the fluid proximate the portion of the carbonator connected to the portion of the cold plate to change location within the carbonator, wherein the change in location causes convection currents of the fluid without external mechanical agitation.

Yet another aspect is a cooling system for use in a beverage dispenser, the cooling system including: a cold plate; a carbonator in thermal communication with the cold plate, the carbonator arranged in a non-horizontal orientation with respect to the cold plate and in contact with a portion of the cold plate, the contact providing heat exchange therebetween; and a fastener adapted to couple the carbonator to the cold plate.

Another aspect is a cooling system for use in a beverage dispenser, the cooling system including: a sweetener inlet; a still water inlet; a cold plate having a first surface and a second surface, the first surface defining a portion of an ice storage area; a nozzle; and a carbonator comprising a gas inlet, a liquid inlet, and a liquid outlet, wherein the carbonator is in thermal communication with the cold plate, the carbonator being oriented in a non-horizontal orientation relative to and on a portion of the first surface of the cold plate.

Yet another aspect is a method for constructing a cooling system, the method including: providing a cold plate; securing a carbonator to the cold plate such that the carbonator is in thermal communication with the cold plate; and configuring the carbonator in a non-horizontal orientation relative to a portion of the cold plate.

DETAILED DESCRIPTION

Figure 1:
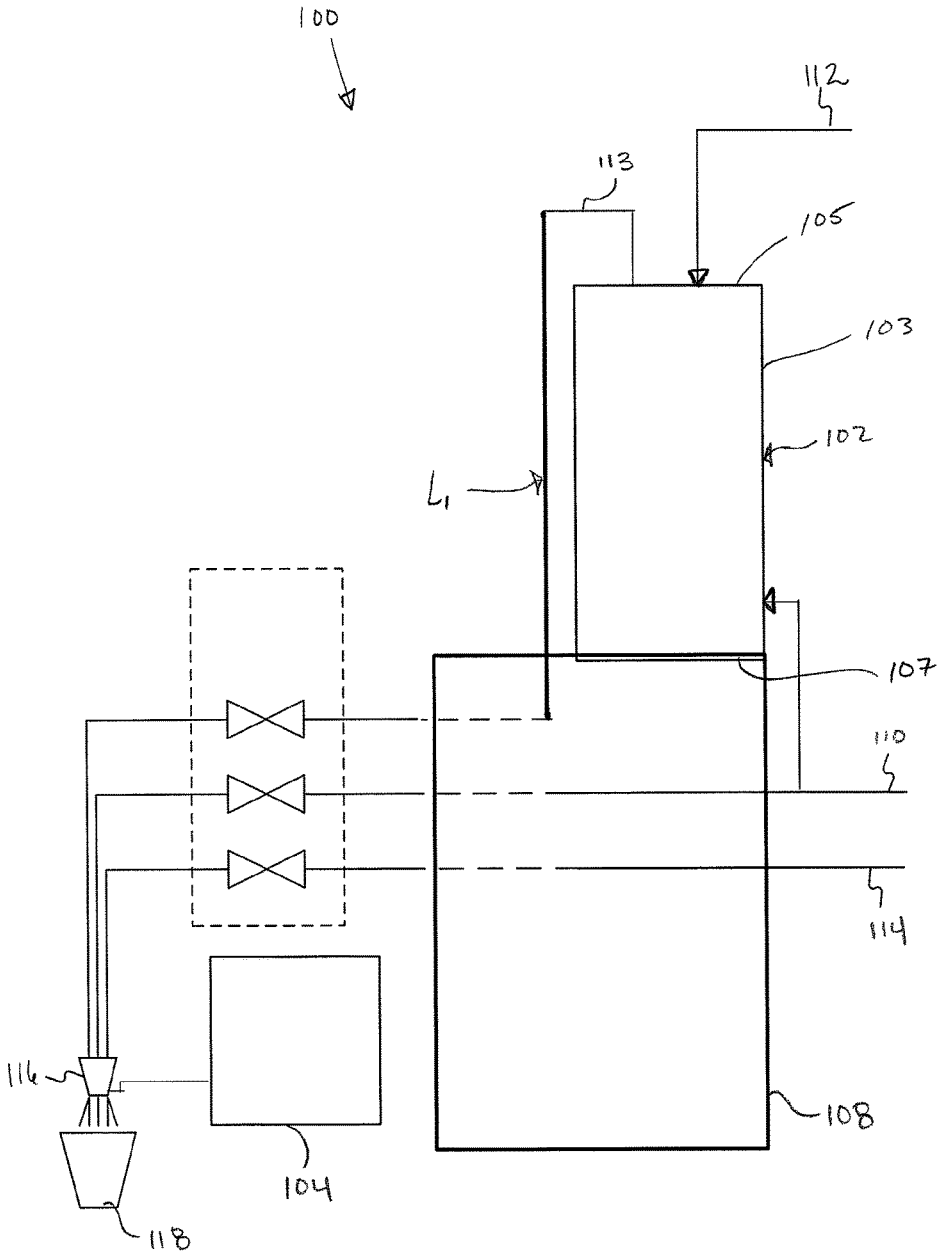
FIG. 1 is a schematic view of an example beverage dispenser in accordance with the principles of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

FIG. 1 is a schematic view of an example beverage dispenser 100. In this example, the beverage dispenser 100 includes a carbonator 102, micro ingredients 104, macro ingredients 114, a cold plate 108, a still water input 110, carbonated water 113, and a carbon dioxide ($CO_2$) input 112. The still water input 110 and the $CO_2$ input 112 supply still water and $CO_2$ to the carbonator 102 to produce the carbonated water 113. In this example, an external $CO_2$ tank is used to pump $CO_2$ to the carbonator 102 through input 112.

During operation, a user selects a beverage using a user interface. Examples of such an interface are described in U.S. Patent Application Ser. No. 61/877,549 filed on Sep.

13, 2013, the entirety of which is hereby incorporated by reference. After the beverage is selected, the user actuates a mechanism (not shown) to dispense the beverage.

During dispensing, a diluent such as carbonated water 113 or still water flows from the carbonator 102 or the still water input 110 to a nozzle 116. In some embodiments, a macro ingredient 114, such as a nutritive sweetener like high fructose corn syrup, flows to the nozzle 116. Additionally, one or more micro-ingredients may be dispensed about the nozzle 116. The various ingredients may flow from the nozzle 116 to form a "post mix" beverage. In other words, the ingredients remain separate until they are mixed about or within the nozzle 116 and are dispensed into a cup 118.

Figure 2:
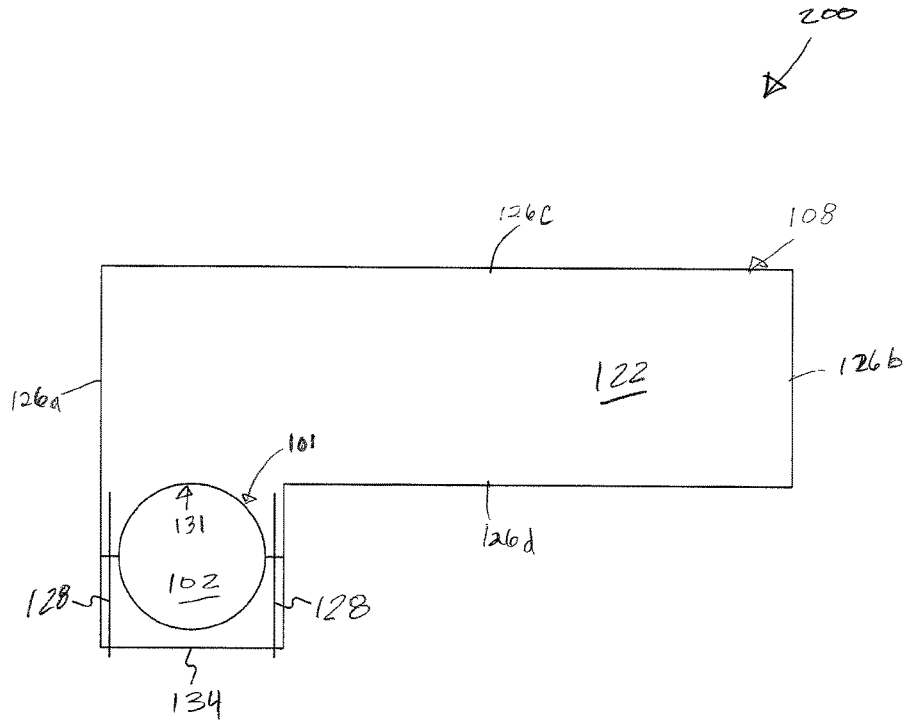
FIG. 2 is schematic top plan view of an example beverage cooling system in accordance with the principles of the present disclosure.
Figure 3:
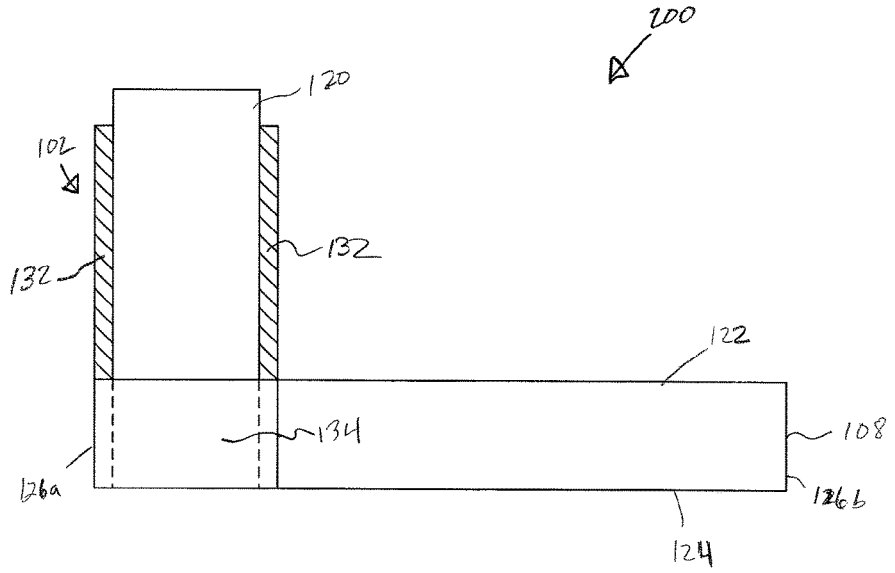
FIG. 3 is a schematic front view of the beverage cooling system shown in FIG. 2.

Referring to FIGS. 2-3, a schematic of a beverage cooling system 200 is shown illustrating the features of the cold plate 108 and the carbonator 102.

FIG. 2 is a schematic view of a portion of the beverage dispenser 100 showing the cold plate 108 and a portion of the carbonator 102 attached thereon to chill the carbonator 102. In one example, a portion of the cold plate 108 may include a contoured section 101 that may match a contour of the carbonator 102. The cold plate 108 can be flat cast metal such as, but not limited to, extruded cast aluminum or stainless steel. The carbonator 102 may also be constructed of an aluminum or stainless steel material. Due to the thermal conductivity of the materials used to form the cold plate 108 and the carbonator 102, the cold plate 108 is able to chill a portion of the contents of the carbonator 102.

In certain examples, the cold plate 108 may be arranged and configured with embedded coils or tubes therein for which fluids travel through to be chilled to an appropriate temperature before being served from the beverage dispenser 100. In other examples, the cold plate 108 may include a heat exchanger having a plurality of fluidic channels integrated (e.g. monolithically formed) therein. The heat exchanger construction helps to increase the surface area to allow for more efficient heat transfer to occur.

The cold plate 108 may be positioned within or form a portion of an ice retaining bin (not shown) such that a layer of ice water contacts the first surface 122. The ice water causes heat exchange between the first surface 122 of the cold plate 108 and the ice water. Water can then flow through the cold plate 108 and be chilled prior to entering the carbonator 102.

Referring to FIG. 3, the cold plate 108 includes a first surface 122, a second surface 124 opposite the first surface 122, and four sidewalls 126 *a-d* there between each having a height substantially equal. In this example, the first surface 122 has a generally planer heat conducting surface. The carbonator 102 can be secured in a substantially vertical orientation using fasteners, such as, bolts 128. The substantially vertical orientation can allow the carbonator 102 to be arranged and configured in a tilted or angled orientation. In some embodiments, the angle of the carbonator 102 can be arranged and configured to be about 45 degrees relative to the cold plate 108.

Still in other embodiments, the carbonator 102 may be arranged and configured to be oriented at an angle of about 40, 50, 60, 70, 80, or 90 degrees relative to the cold plate 108. It is acknowledged that the degree of tilt or angle for the carbonator 102 may vary in other embodiments.

In some embodiments, the carbonator 102 can be arranged and configured to be oriented in a non-horizontal orientation. Other orientations or positions may be possible in accordance with this disclosure.

In one embodiment, a lower portion 130 of a carbonator side wall 131 can be arranged and configured to mate to a portion of the first surface 122 of the cold plate 108 such that the lower portion 130 of the carbonator side wall 131 is cooled.

The carbonator 102 can include insulated walls 132 to help minimize warming of the contents within the carbonator 102. In other examples, fillers with high thermal conductivity may be sandwiched between the first surface 122 of the cold plate 108 and the lower portion 130 of the carbonator side wall 131 to help improve heat transfer between the cold plate 108 and the carbonator 102.

Typically during start up times, beverages may be less carbonated because of the overnight temperature rise in the carbonator 102. Because a carbonator 102 that is warmed is not able to dissolve as much $CO_2$, a lower quality (i.e., less carbonated) beverage can be dispensed. Chilling the carbonator 102 by using a portion of the cold plate 108 can increase the ability to dissolve $CO_2$ in the carbonator tank 120. The more $CO_2$ dissolved can result in an increased beverage quality and consistency even during times of high demand because the carbonator 102 can produce and maintain soda with a higher $CO_2$ concentration. Providing cold water to the carbonator 102 can increase the carbonation level in the carbonator 102. The carbonator 102 can be maintained at temperatures at or below 40° F. to make carbonated drinks with water.

In one example, the top of the carbonator 102 can be in close proximity to the nozzle 116 such that the length of tubing $L_1$ between the carbonator 102 and the nozzle 116 can be significantly reduced. The reduction in length of tubing $L_1$ can reduce the amount of dead space or volume in the tubing and improve the quality of beverage being dispensed. The reduction of length of tubing $L_1$ can also help improve the beverage quality after the dispenser has been idle for some time. When the dispenser becomes idle without dispensing beverages, the ambient soda in the tubing can increase the average temperature of the dispensed beverage. Having the top of the carbonator 102 close to the nozzle 116 can help address this issue because the shorter tubing lengths under ambient conditions can lower the dispensed beverage temperature and increase the carbonation level of the dispensed beverage. Minimizing the length of tubing $L_1$ can help dispense colder beverages.

Referring again to FIG. 2, the carbonator 102 is arranged and configured on a portion of the cold plate 108 in a substantially vertical orientation. In some embodiments, the cold plate 108 can be angled such that it slopes downward with the lowest point being at the bottom. In one example, the cold plate 108 can contact the carbonator 102 at the lower portion 130 of the carbonator side wall 131. The carbonator 102 has minimal but sufficient contact with the cold plate 108 to allow the cold plate 108 to absorb heat from the carbonator 102.

Figure 4:
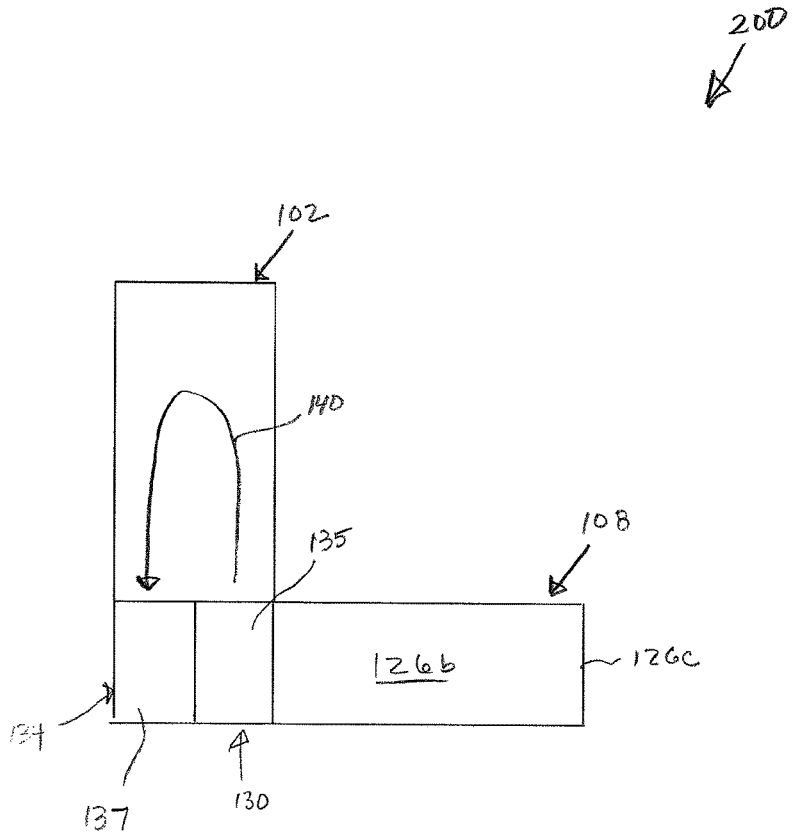
FIG. 4 is a schematic side view of the beverage cooling system shown in FIG. 2.

Referring to FIG. 4, a schematic side view of the beverage cooling system 200 is shown.

In one example, fluid 135 next to the cold plate 108 can cool to about 34° F. such that its density decreases. This cooling can cause the fluid 135 next to the cold plate 108 to rise. The rising fluid 135 inside the carbonator 102 can be replaced by fluid 137 with a temperature of about 40° F., which can cause convection currents 140 to occur inside the carbonator 102. The convection currents 140 help to churn the contents inside the carbonator 102 to achieve a more uniform temperature distribution within the carbonator 102 as the colder water rises to the top and the warmer water sinks to the bottom.

Referring again to FIG. 1, the carbonator includes a body 103 that extends from a proximal end 105 to a distal end 107.

The distal end 107 of the carbonator 102 is arranged and configured on the cold plate 108 such that the depth of carbonated water is not as shallow thereby a more consistent carbonation level can be achieved. In addition, with the distal end 107 of the carbonator 102 on the cold plate 108, the carbonator 102 remains accessible for performing maintenance or services thereon and can be more easily accessed for maintenance or services.

As shown in FIGS. 2-3, a cap 134 may be secured (e.g., bolted) to the cold plate 108 to secure the carbonator 102 to the cold plate 108. In one example, the cap 134 may be constructed of a plastic material. The plastic may be polypropylene, polyethylene, or other polymer based material. The plastic may help allow the cap 134 to act as insulation to minimize heat transfer from the carbonator 102. The cap 134 being made of a plastic material may help allow the connection to have a degree of flexibility to allow the carbonator 102 and the cold plate 108 to move independently of one another. The movement may be caused by thermal expansion and contraction as well as vibrations due to dispenser operations. Other attachment techniques may be used, such as for example, diffusion, soldering, welding, adhesive, or combinations of these or other fasteners that act as an insulator.

In other examples, a thermal paste may be used as a sealant around the cap 134. The thermal paste may have a high thermal conductivity to conduct heat well. In certain examples, the thermal paste may be applied between the mating surfaces 122, 130 of the cold plate 108 and the carbonator 102 to help improve the heat transfer between the cold plate 108 and the carbonator 102.

Figure 5:
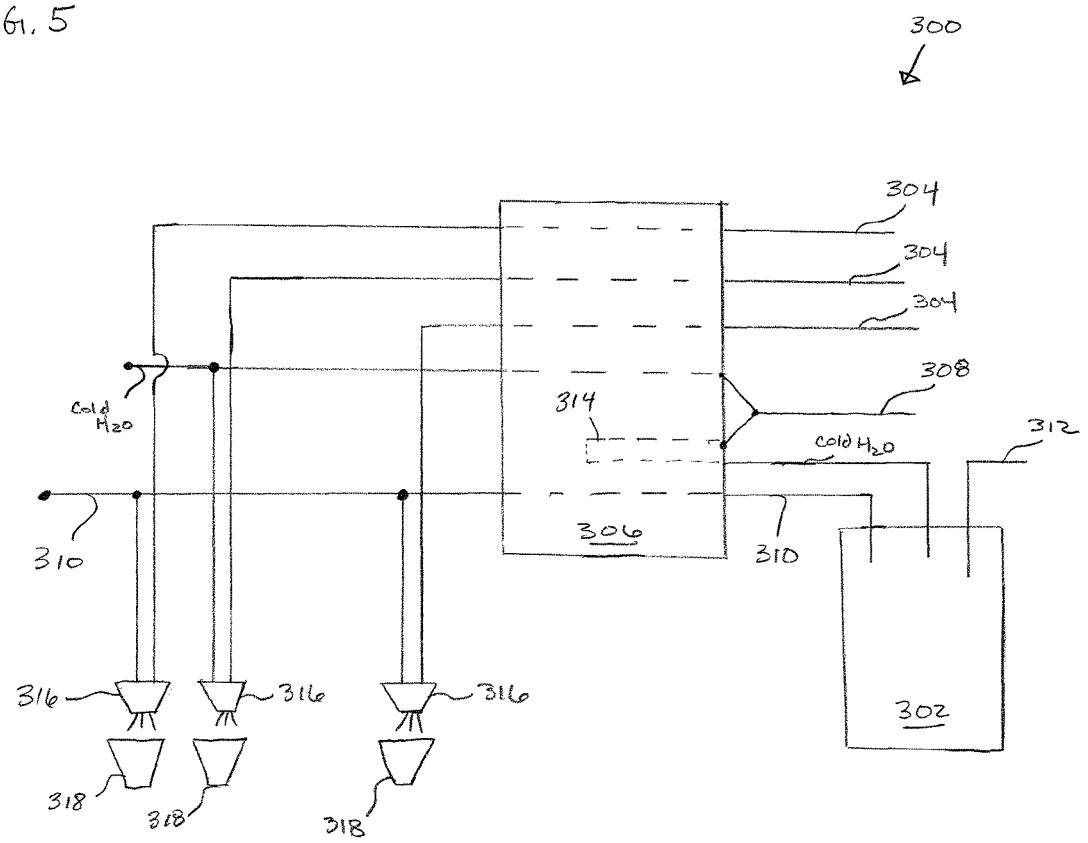
FIG. 5 is a schematic view of an alternate beverage dispenser in accordance with the principles of the present disclosure.

FIG. 5 is a schematic view of an example beverage dispenser 300. In this example, the beverage dispenser 300 includes a carbonator 302, beverage ingredients 304, a cold plate 306, a still water input 308, carbonated water 310, a carbon dioxide ($CO_2$) input 312, and a pre-chiller circuit 314.

In this example, the cold plate 306 is located adjacent a bottom of an ice bin (not shown) to enable heat transfer between the ice and beverage fluids. The still water input 308 and the $CO_2$ input 312 supply still water and $CO_2$ to the carbonator 302 to produce the carbonated water 310. In this example, an external $CO_2$ tank is used to pump $CO_2$ to the carbonator 302 through input 312.

In one embodiment, during dispensing, a diluent such as carbonated water 310 or still water flows from the carbonator 302 or the still water input 308 across the cold plate 306 to a nozzle 316. Cold still water is provided via local plumbing and sometimes in conjunction with a water booster to maintain consistent water pressure. The still water input 308 provides water to the pre-chiller circuit 314.

In the present example embodiment, there is a separate nozzle 316 for each beverage ingredient 304. In one example, the beverage dispenser 300 may have one or more multi-flavor nozzles for dispensing more than one flavor of beverage. In other examples, the beverage dispenser 300 may have a combination of single flavor and multi-flavor nozzles.

In some examples, the beverage ingredient 304, may include a nutritive sweetener like high fructose corn syrup. The beverage ingredient 304 can be provided in a bag-in-box type configuration. The various ingredients remain separate until they are mixed about or within the nozzle 316 with cold water or carbonated water and are dispensed into a cup 318. The beverage ingredient 304 is mixed with a diluent to produce a finished beverage. The beverage typically has a reconstitution ratio from about 3:1 to 6:1.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A cooling system for use in a beverage dispenser, the cooling system comprising:
- a cold plate having a top surface and a side surface;
- a carbonator arranged non-horizontally to the cold plate, the carbonator having a body extending from a proximal end to a distal end, the carbonator further including:
  - a sidewall, with a lower uninsulated portion of the sidewall on the distal end of the carbonator being in thermal communication with the side surface of the cold plate and an upper portion of the sidewall on the proximal end located away from the cold plate;
  - a still water input; and
  - an output for carbonated water; and
- a fastener coupling the carbonator to the cold plate, the fastener having a lower thermal conductivity as compared to a thermal conductivity of the carbonator.

2. The cooling system of claim 1, wherein the sidewall of the carbonator has a curved surface and the side surface of the cold plate includes a contour to match a curvature of the curved surface.

3. The cooling system of claim 1, further comprising a paste located between the lower uninsulated portion of the sidewall and the side surface of the cold plate, the paste having a high thermal conductivity.

4. The cooling system of claim 1, wherein the carbonator is insulated, except for the lower uninsulated portion of the sidewall.

5. The cooling system of claim 1, wherein the carbonator is configured to move independently of the cold plate due to thermal expansion and vibrations.

6. The cooling system of claim 1, wherein the lower uninsulated portion of the sidewall in thermal communication with the side surface of the cold plate is configured to cause convection currents of a fluid within the carbonator.

7. The cooling system of claim 1, wherein the fastener is bolted to the cold plate.

8. The cooling system of claim 1, wherein the fastener is constructed of a polymer.

9. The cooling system of claim 1, wherein the carbonator is positioned at an angle of from approximately 40-90 degrees from the cold plate.

10. The cooling system of claim 1, wherein the carbonator is positioned at an angle of approximately 45 degrees from the cold plate.

11. The cooling system of claim 1, wherein the fastener is configured to provide flexibility between the carbonator and the cold plate such that the carbonator and the cold plate can move independently of one another.

12. The cooling system of claim 1, wherein the fastener is a cap.

13. A cooling system for use in a beverage dispenser, the cooling system comprising:
- a cold plate; and
- a carbonator in thermal communication with the cold plate at a first end of the carbonator, the carbonator arranged in a non-horizontal orientation with respect to the cold plate such that the carbonator extends away from the cold plate from the first end of the carbonator to a second end of the carbonator, such that the second end of the carbonator is not in physical contact with the cold plate, and further wherein the carbonator includes a liquid inlet and a liquid outlet; and further wherein the carbonator is positioned at an angle of approximately 45 degrees from the cold plate.

14. The cooling system of claim 13, wherein the carbonator is configured to move independently of the cold plate due to thermal expansion and vibrations.

15. The cooling system of claim 13, further comprising a fastener coupling the carbonator to the cold plate, the fastener having a lower thermal conductivity as compared to a thermal conductivity of the carbonator.

16. The cooling system of claim 15, wherein the fastener is bolted to the cold plate.

17. The cooling system of claim 15, wherein the fastener is constructed of a polymer.

18. The cooling system of claim 15, wherein the fastener is a cap.

* * * * *